US008614721B2

(12) United States Patent
Nakanishi et al.

(10) Patent No.: US 8,614,721 B2
(45) Date of Patent: Dec. 24, 2013

(54) LIQUID CRYSTAL DISPLAY DEVICE AND POTENTIAL SETTING METHOD FOR THE SAME

(75) Inventors: Youhei Nakanishi, Osaka (JP); Masanobu Mizusaki, Osaka (JP); Takashi Katayama, Osaka (JP); Takeshi Noma, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 169 days.

(21) Appl. No.: 13/382,236

(22) PCT Filed: Mar. 25, 2010

(86) PCT No.: PCT/JP2010/002143

§ 371 (c)(1),
(2), (4) Date: Jan. 4, 2012

(87) PCT Pub. No.: WO2011/024338

PCT Pub. Date: Mar. 3, 2011

(65) Prior Publication Data

US 2012/0105510 A1 May 3, 2012

(30) Foreign Application Priority Data

Aug. 28, 2009 (JP) ..... 2009-198706

(51) Int. Cl.
*G09G 5/10* (2006.01)

(52) U.S. Cl.
USPC ..... 345/690; 345/89

(58) Field of Classification Search
USPC ..... 345/690, 89
See application file for complete search history.

(56) References Cited

U.S. PATENT DOCUMENTS

| | | | | |
|---|---|---|---|---|
| 7,671,930 | B2 * | 3/2010 | Lin | 349/39 |
| 2002/0011984 | A1 | 1/2002 | Shirochi et al. | |
| 2005/0219186 | A1 * | 10/2005 | Kamada et al. | 345/90 |
| 2006/0139543 | A1 * | 6/2006 | Kim et al. | 349/141 |
| 2008/0273000 | A1 * | 11/2008 | Park et al. | 345/89 |
| 2008/0297538 | A1 * | 12/2008 | Cho et al. | 345/690 |
| 2010/0002021 | A1 * | 1/2010 | Hashimoto et al. | 345/690 |
| 2010/0134473 | A1 * | 6/2010 | Matsuda et al. | 345/213 |

FOREIGN PATENT DOCUMENTS

| | | | |
|---|---|---|---|
| JP | 05-323379 | A | 12/1993 |
| JP | 2002049020 | A | 2/2002 |
| JP | 2003216124 | A | 7/2003 |
| JP | 2007065076 | A | 3/2007 |
| JP | 2008216363 | A | 9/2008 |
| JP | 2008233283 | A | 10/2008 |
| JP | 2009058694 | A | 3/2009 |

* cited by examiner

*Primary Examiner* — Lun-Yi Lao
*Assistant Examiner* — Kelly B Hegarty
(74) *Attorney, Agent, or Firm* — Harness, Dickey & Pierce, P.L.C.

(57) ABSTRACT

A liquid crystal display device includes source bus lines, gate bus lines intersecting with the source bus lines, pixels arranged in a matrix to correspond to intersections between the gate bus lines and the source bus lines, each of the pixels including a TFT, a pixel electrode, a common electrode, and a liquid crystal layer, and a potential control section for controlling the potential of the common electrode. The potential control section sets a voltage, obtained by reducing potential $V_{cenf255}$ of the common electrode at which flicker is minimum in display of gray level as black display and gray level as white display alternately every pixel by a predetermined voltage, as center voltage $V_{cen255}$ of the potential of the common electrode in display of gray level for all the pixels.

4 Claims, 8 Drawing Sheets

LIQUID CRYSTAL DISPLAY DEVICE AND POTENTIAL SETTING METHOD FOR THE SAME

TECHNICAL FIELD

The present disclosure relates to an active matrix liquid crystal display device using switching elements such as thin film transistors, and a potential setting method for the same.

BACKGROUND ART

In recent years, active matrix liquid crystal display devices, which have advantages of being thin and lightweight, capable of low-voltage drive, and small in power consumption, have been widely used as display panels for mobile terminal equipment such as mobile phones and handheld game machines and various electronic equipment such as notebook computers.

Such an active matrix liquid crystal display device includes, in its main portion, a liquid crystal display panel as a display section having a plurality of pixels arranged in a matrix and drive circuits for the display panel. In the liquid crystal display panel, a plurality of data signal lines (hereinafter referred to as "source bus lines") and a plurality of scanning signal lines (hereinafter referred to as "gate bus lines") are formed to intersect each other in a lattice shape, and also a plurality of storage capacitance lines are formed to extend in parallel with the plurality of gate bus lines. One pixel corresponds to each of intersections between the plurality of source bus lines and the plurality of gate bus lines. The liquid crystal display panel also includes a common electrode (or a counter electrode) placed in common for the plurality of pixels arranged in a matrix to face pixel electrodes of the pixels via a liquid crystal layer.

FIG. 13 is an equivalent circuit diagram showing an electrical configuration of one pixel in the liquid crystal display panel of the liquid crystal display device described above. Each pixel includes: a thin film transistor (hereinafter abbreviated as a "TFT") 52 as a switching element having a source electrode connected to a source bus line 50 passing through an intersection corresponding to this pixel and a gate electrode connected to a gate bus line 51 passing through the intersection; and a pixel electrode 53 connected to a drain electrode of the TFT 52. A liquid crystal capacitance $C_{lc}$ is formed by the pixel electrode 53 and a common electrode 54, and a storage capacitance $C_s$ is formed by the pixel electrode 53 and a storage capacitance line formed along the gate bus line 51. The liquid crystal capacitance $C_{lc}$ and the storage capacitance $C_s$ constitute a pixel capacitance for holding a voltage indicating the pixel value that should be provided by the pixel. Also, a parasitic capacitance $C_{gd}$ is formed between the pixel electrode 53 and the gate bus line 51.

With the presence of the parasitic capacitance $C_{gd}$ between the gate bus line 51 and the pixel electrode 53 in each pixel, during the time when a data signal is being applied to the source bus line, the potential (pixel potential) $V_d$ of the pixel electrode 53 has a level shift $\Delta V_d$ caused by the parasitic capacitance $C_{gd}$ at the time of fall of the voltage of a scanning signal from an ON voltage $V_{gh}$ of the gate bus line 51 to an OFF voltage $V_{gh}$ thereof. This level shift $\Delta V_d$, which is called a "field through voltage" or a "pull-in voltage," is represented by:

$$\Delta V_d=(V_{gh}-V_{gl})\cdot C_{gd}/(C_{lc}+C_s+C_{gd}) \quad (1)$$

Such a pull-in voltage $\Delta V_d$ causes occurrence of flicker, display degradation, etc. on a displayed image. In general, in a liquid crystal display panel driven with TFTs, flicker tends to occur when an asymmetric voltage is applied to the liquid crystal layer, greatly degrading the display quality, and moreover causing image sticking if the flicker is left unattended for a long time.

Also, in general, a liquid crystal display device is AC-driven where a positive voltage and a negative voltage are alternately applied to liquid crystal because liquid crystal is degraded with application of a DC voltage over a long time. Types of the AC drive include frame inversion drive, line inversion drive, and dot inversion drive. In the AC drive, the voltage applied to the common electrode (hereinafter such a voltage is referred to as the common electrode voltage $V_{com}$) is kept constant, or the level of the common electrode voltage $V_{com}$ is changed.

If the common electrode voltage $V_{com}$ shifts slightly, for example, the potentials of all pixels will shift in the same direction when all the pixels are of the same polarity. Therefore, the entire screen will become bright and then dark frame by frame repeatedly, and as a result, a large flicker will occur. In view of this, in a liquid crystal display panel driven with TFTs, the dot inversion drive where the voltages applied to any adjoining pixels are opposite in polarity and the polarity of each pixel is inverted every frame is widely used. By inverting the polarity every dot (i.e., every pixel), any adjoining pixels constitute a set of a bright pixel and a dark pixel. Therefore, the change in brightness can be cancelled to some extent, and thus, as a whole, flicker can be reduced to some extent.

Various schemes of dot inversion drive, not limited to the simple dot inversion drive, have been recently proposed. Basically, however, these schemes are common in that, in the same frame, while the polarity of the potential is positive in some of the pixel electrodes in the panel plane, it is negative in the other (see Patent Document 1, for example).

In general, in the dot inversion drive, which is a drive for rendering flicker less discernable, setting of the common electrode voltage $V_{com}$ is difficult. In view of this, setting of the common electrode voltage $V_{com}$ may be made in a display of the same polarity over the entire screen using a dot checkered pattern that renders flicker discernible. The dot checkered pattern is a display pattern of allowing only pixels of the same polarity to light up, where gray level 0, or a gray level close to 0, is written into pixels that do not light up. Pixels light up every other dot in the horizontal and vertical directions in the case of the dot inversion drive.

It appears possible to set the common electrode voltage $V_{com}$ and the potentials of the source bus lines so that flicker is minimized by a theoretical method. Actually, however, the setting does not go according to calculation due to a slight deviation of a finished size from its design value, etc. In view of this, a technique has been proposed where a pattern of the same gray level (hereinafter referred to as a "solid pattern") is actually displayed on the entire panel plane (i.e., all pixels) of a liquid crystal display panel, and the common electrode voltage $V_{com}$ is changed while this pattern is being displayed, to find the common electrode voltage $V_{com}$ at which flicker is minimum, and then determine the potentials (see Patent Document 2, for example).

As described above, methods of adjusting the common electrode potential $V_{com}$ or the potentials supplied to the source bus lines while displaying a pattern rendering flicker discernible have been generally adopted.

CITATION LIST

Patent Document

PATENT DOCUMENT 1: Japanese Patent Publication No. 2003-216124

PATENT DOCUMENT 1: Japanese Patent Publication No. H05-323379

SUMMARY OF THE INVENTION

Technical Problem

The common electrode voltage $V_{com}$ adjusted using the dot checkered pattern in the dot inversion drive described above may not be the same as the optimum value of the common electrode voltage $V_{com}$ adjusted using the solid pattern described above.

More specifically, the potential of a source bus line is set considering the pull-in voltage generated by the parasitic capacitance $C_{gd}$, to ensure that a symmetric voltage is applied to the liquid crystal layer. Since the pull-in voltage by the parasitic capacitance $C_{gd}$ for a high gray level is different from that for a low gray level, the center voltage of the potential of the source bus line is set to vary with the gray level accordingly. For example, in the normally black mode, the center voltage of the potential of the source bus line set to display a low gray level is higher than the center voltage of the source bus line set to display a high gray level. Also, the pixel potential is affected by, not only the pull-in voltage by the parasitic capacitance $C_{gd}$ described above, but also a pull-in voltage by a parasitic capacitance $C_{sd}$ formed between the data signal line and the drain of the switching element. In the dot checkered pattern, when a given pixel has a high gray level, any adjoining pixel has 0 or a low gray level and is opposite in polarity. The average potential of the source bus lines for displaying the dot checkered pattern is the average of the set potentials for displaying a high gray level and 0 or a low gray level. Contrarily, in the solid pattern, any adjoining pixels have the same gray level and are opposite in polarity. The average potential of the source bus lines for displaying the solid pattern is the average of the set potentials for displaying a high gray level. In the normally black mode, for example, since the center voltage of the potential of the source bus line set to display a low gray level is higher than the center voltage of the source bus line set to display a high gray level. Therefore, the average voltage of the source bus lines after write of potentials into the pixel electrodes is higher in the solid pattern than in the dot checkered pattern, and also the pull-in voltage by the parasitic capacitance $C_{sd}$ is small in the solid pattern. Thus, since the common electrode potential $V_{com}$ adjusted using the dot checkered pattern is higher than the common electrode potential $V_{com}$ adjusted using the solid pattern, the common electrode potential $V_{com}$ does not necessarily become the optimum value even when it is adjusted using the dot checkered pattern in the dot inversion drive. As a result, with an asymmetric voltage applied to the liquid crystal layer, flicker may occur, causing problems that the display quality may greatly degrade and moreover image sticking may occur if the flicker is left unattended for a long time.

It is an objective of the present disclosure to provide a liquid crystal display device where occurrence of image sticking caused by flicker can be prevented, and a potential setting method for the same.

Solution to the Problem

To attain the above objective, the liquid crystal display device of the present disclosure includes: a plurality of data signal lines; a plurality of scanning signal lines intersecting with the plurality of data signal lines; a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode; and a potential control section configured to control the potential of the common electrode, wherein when $C_{sd}$ is a parasitic capacitance formed between the data signal line and a drain of the switching element, $C_{lc}$ is a liquid crystal capacitance, $C_s$ is a storage capacitance, gray level 0 denotes black display, and gray level 255 denotes white display, when, in the case of alternate display of gray level 0 and gray level 255 every pixel, $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{H255}$ is a potential set for the data signal line to apply a positive potential required for display of gray level 255 to the pixel electrode, $V_{L255}$ is a potential set for the data signal line to apply a negative potential required for display of gray level 255 to the pixel electrode, and $V_{cenf255}$ is a potential of the common electrode at which flicker is minimum, and when, in the case of display of gray level 255 for all the plurality of pixels, $V_{cen255}$ is a potential of the common electrode at which flicker is minimum, the potential control section sets a potential obtained by reducing $V_{cenf255}$ by $$\frac{1}{4}\cdot\frac{C_{sd}}{C_{lc}+C_s+C_{sd}}(V_{H0}+V_{L0}-V_{H225}-V_{L255})$$

as $V_{cen255}$.

With the configuration described above, considering the difference from the potential of the common electrode set in the state of displaying gray level 0 and gray level 255 alternately every pixel, the potential of the common electrode and the center voltage of the potentials of the pixel electrodes in the case of display of gray level 255 for all the plurality of pixels can be made to match with each other. Therefore, a symmetric voltage can be applied to the liquid crystal layer, and thus degradation in display quality can be prevented, and also occurrence of image sticking can be prevented.

Alternatively, the liquid crystal display device of the present disclosure includes: a plurality of data signal lines; a plurality of scanning signal lines intersecting with the plurality of data signal lines; a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected selected, a pixel electrode connected to the corresponding data signal line via the switching element, a common electrode opposed to the pixel electrode, and a liquid crystal layer sandwiched between the pixel electrode and the common electrode; and a potential control section configured to control the potential of the common electrode, wherein when $C_{lca}$, $C_{lcb}$, and $C_{lc255}$ are respectively liquid crystal capacitances in gray level a, gray level b, and gray level 255, gray levels a and b being two arbitrary halftones obtained when black display is defined as gray level 0 and white display as gray level 255 and the brightness therebetween is divided into 254 levels, when $\nu_a=-(V_{H0}+V_{L0}-V_{Ha}-V_{La})$, $\nu_b=-(V_{H0}+V_{L0}-V_{Hb}-V_{Lb})$, and $v_{255}=-(V_{H0}+V_{L0}-V_{H255}-V_{L255})$ are defined where $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{Ha}$ is a potential set for the data signal line to apply a positive potential required for display of gray level a to the pixel electrode, $V_{La}$ is a potential set for the data signal line to apply a negative potential required for display of gray level a to the pixel electrode, $V_{Hb}$ is a potential set for the data signal line to apply a positive potential required for display of gray level b to the pixel electrode, $V_{Lb}$ is a potential set for the data signal line to apply a negative potential required for display of gray level b to the pixel electrode, $V_{H255}$ is a potential set for the data signal line to apply a positive potential required for display of gray level 255 to the pixel electrode, and $V_{L255}$ is a potential set for the data signal line to apply a negative potential required for display of gray level 255 to the pixel electrode, and when $\Delta V_{cena}=V_{cena}-V_{cenfa}$ and $\Delta V_{cenb}=V_{cenb}-V_{cenfb}$ are defined where $V_{cenfa}$ is a potential of the common electrode at which flicker is minimum in the case of alternate display of gray level 0 and gray level a every pixel, $V_{cenfb}$ is a potential of the common electrode at which flicker is minimum in the case of alternate display of gray level 0 and gray level b every pixel, and $V_{cena}$ and $V_{cenb}$ are potentials of the common electrode at which flicker is minimum in the case of display of gray level a and gray level b, respectively, for all the plurality of pixels, the potential control section sets a potential obtained by adding $$\frac{v_{255}}{\left(\frac{v_a}{\Delta V_{cen_a}}-\frac{v_b}{\Delta V_{cen_b}}\right)\cdot C_{lc_{255}}\cdot\frac{1-\frac{C_{lc_a}}{C_{lc_{255}}}}{\frac{C_{lc_a}}{C_{lc_{255}}}-\frac{C_{lc_b}}{C_{lc_{255}}}}+\frac{v_a}{\Delta V_{cen_a}}}$$

to $V_{cenf255}$ as $V_{cen255}$.

With the configuration described above, considering the difference from the potential of the common electrode set in the state of displaying gray level 0 and gray level 255 alternately every pixel, the potential $V_{com255}$ of the common electrode and the center voltage of the potentials of the pixel electrodes in the case of display of gray level 255 for all the plurality of pixels can be made to match with each other. Therefore, a symmetric voltage can be applied to the liquid crystal layer, and thus degradation in display quality can be prevented, and also occurrence of image sticking can be prevented.

Moreover, since the setting of the potential of the common electrode in the case of display of gray level 255 for all the plurality of pixels is possible without use of a parasitic capacitance of which the actual value does not necessarily match with its design value, the potential $V_{com255}$ of the common electrode and the center voltage of the potentials of the pixel electrodes can be made to match with each other further precisely.

The potential setting method for a liquid crystal display device of the present disclosure is a potential setting method for a liquid crystal display device including a plurality of data signal lines, a plurality of scanning signal lines intersecting with the plurality of data signal lines, and a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode, the method at least including the steps of: displaying gray level 0 as black display and gray level 255 as white display alternately every pixel; setting a voltage at which flicker is minimum during the alternate display of gray level 0 and gray level 255 every pixel as a center voltage $V_{cenf255}$ of the potential of the common electrode; and setting a potential obtained by reducing $V_{cenf255}$ by $$\frac{1}{4}\cdot\frac{C_{sd}}{C_{lc}+C_s+C_{sd}}(V_{H0}+V_{L0}-V_{H255}-V_{L255})$$

(where $C_{sd}$ is a parasitic capacitance formed between the data signal line and a drain of the switching element, $C_{lc}$ is a liquid crystal capacitance, $C_s$ is a storage capacitance, $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{H255}$ is a potential set for the data signal line to apply a positive potential required for display of gray level 255 to the pixel electrode, and $V_{L255}$ is a potential set for the data signal line to apply a negative potential required for display of gray level 255 to the pixel electrode) as a potential $V_{cen255}$ of the common electrode in the case of display of gray level 255 for all the plurality of pixels.

With the configuration described above, considering the difference from the potential of the common electrode set in the state of displaying gray level 0 and gray level 255 alternately every pixel, the potential of the common electrode and the center voltage of the potentials of the pixel electrodes in the case of display of gray level 255 for all the plurality of pixels can be made to match with each other. Therefore, a symmetric voltage can be applied to the liquid crystal layer, and thus degradation in display quality can be prevented, and also occurrence of image sticking can be prevented.

Alternatively, the potential setting method for a liquid crystal display device of the present disclosure is a potential setting method for a liquid crystal display device including a plurality of data signal lines, a plurality of scanning signal lines intersecting with the plurality of data signal lines, and a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode, the method at least including the steps of: displaying gray level 0 as black display and gray level 255 as white display alternately every pixel; determining a voltage $V_{cenf255}$ of the common electrode at which flicker is minimum during the alternate display of gray level 0 and gray level 255 every pixel; displaying gray level 0 and gray level a as an arbitrary halftone alternately every pixel; determining a voltage $V_{cenfa}$ of the common electrode at which flicker is minimum during the alternate display of gray level 0 and gray level a every pixel; displaying gray level 0 and gray level b as an arbitrary halftone alternately every pixel; determining a voltage $V_{cenfb}$ of the common electrode at which flicker is minimum during the alternate display of gray level 0 and gray level b every pixel; displaying gray level a for all the plurality of pixels; determining a voltage $V_{cena}$ of the common electrode at which flicker is minimum during the display of gray level a for all the plurality of pixels; displaying gray level b for all the plurality of pixels; determining a voltage $V_{cenb}$ of the common electrode at which flicker is minimum during the display of gray level b for all the plurality of pixels; measuring a characteristic between a liquid crystal capacitance and a voltage applied to the liquid crystal layer; determining voltages applied to the liquid crystal layer in gray level a, gray level b, and gray level 255; determining liquid crystal capacitances $C_{lca}$, $C_{lcb}$, and $C_{lc225}$ in gray level a, gray level b, and gray level 255, respectively, based on the characteristic between the liquid crystal capacitance and the voltage applied to the liquid crystal layer and the voltages applied to the liquid crystal layer in gray level a, gray level b, and gray level 255; and setting a voltage obtained by adding $$\frac{v_{255}}{\left(\frac{v_a}{\Delta V_{cen_a}} - \frac{v_b}{\Delta V_{cen_b}}\right) \cdot C_{lc255} \cdot \frac{1 - \frac{C_{lc_a}}{C_{lc255}}}{\frac{C_{lc_a}}{C_{lc255}} - \frac{C_{lc_b}}{C_{lc255}}} + \frac{v_a}{\Delta V_{cen_a}}}$$

(where $\Delta V_{cena}=V_{cena}-V_{cenfa}$, $\Delta V_{cenb}-V_{cenb\ l\ -Vcenfb}$, $v_a=-(V_{H0}+V_{L0}-V_{Ha}-V_{La})$, $v_b=(V_{H0}+V_{L0}-V_{Hb}-V_{Lb})$, $v_{255}=-(V_{H0}+V_{L0}-V_{H255}-V_{L255})$, $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{Ha}$ is a potential set for the data signal line to apply a positive potential required for display of gray level a to the pixel electrode, $V_{La}$ is a potential set for the data signal line to apply a negative potential required for display of gray level a to the pixel electrode, $V_{Hb}$ is a potential set for the data signal line to apply a positive potential required for display of gray level b to the pixel electrode, $V_{Lb}$ is a potential set for the data signal line to apply a negative potential required for display of gray level b to the pixel electrode, $V_{H255}$ is a potential set for the data signal line to apply a positive potential required for display of gray level 255 to the pixel electrode, and $V_{L255}$ is a potential set for the data signal line to apply a negative potential required for display of gray level 255 to the pixel electrode) to the voltage $V_{cenf255}$ of the common electrode as a voltage $V_{cen255}$ of the common electrode in the case of display of gray level 255 for all the plurality of pixels.

With the configuration described above, considering the difference from the potential of the common electrode set in the state of displaying gray level 0 and gray level 255 alternately every pixel, the potential $V_{com255}$ of the common electrode and the center voltage of the potentials of the pixel electrodes in the case of display of gray level 255 for all the plurality of pixels can be made to match with each other. Therefore, a symmetric voltage can be applied to the liquid crystal layer, and thus degradation in display quality can be prevented, and also occurrence of image sticking can be prevented.

Moreover, since the setting of the potential of the common electrode in the case of display of gray level 255 for all the plurality of pixels is possible without use of a parasitic capacitance of which the actual value does not necessarily match with its design value, the potential $V_{com255}$ of the common electrode and the center voltage of the potentials of the pixel electrodes can be made to match with each other further precisely.

Alternatively, the potential setting method for a liquid crystal display device of the present disclosure is a potential setting method for a liquid crystal display device including a plurality of data signal lines; a plurality of scanning signal lines intersecting with the plurality of data signal lines; a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode, the method at least including the steps of: displaying a given gray level in a range of gray level 223 to gray level 247, obtained when black display is defined as gray level 0 and white display as gray level 255 and the brightness therebetween is divided into 254 levels, for all the plurality of pixels; and setting a voltage at which flicker is minimum during the display of the given gray level in the range of gray level 223 to gray level 247 for all the plurality of pixels, as a common electrode potential.

With the configuration described above, an appropriate common electrode potential can be set while permitting easy detection of flicker. Also, the center voltage of the potentials of the pixel electrodes in the case of display of a given gray level in the range of gray level 223 to gray level 247 for all the plurality of pixels can be made to match with the common electrode voltage, whereby a symmetric voltage can be applied to the liquid crystal layer. Thus, degradation in display quality can be prevented, and also occurrence of image sticking can be prevented.

Advantages of the Invention

According to the present disclosure, a symmetric voltage can be applied to the liquid crystal layer. Thus, degradation in display quality can be prevented, and also occurrence of image sticking due to flicker can be prevented.

DESCRIPTION OF EMBODIMENTS

Embodiments of the present disclosure will be described hereinafter with reference to the accompanying drawings. It should be noted that the present disclosure is not limited to the following embodiments.

(First Embodiment)

Figure 1:
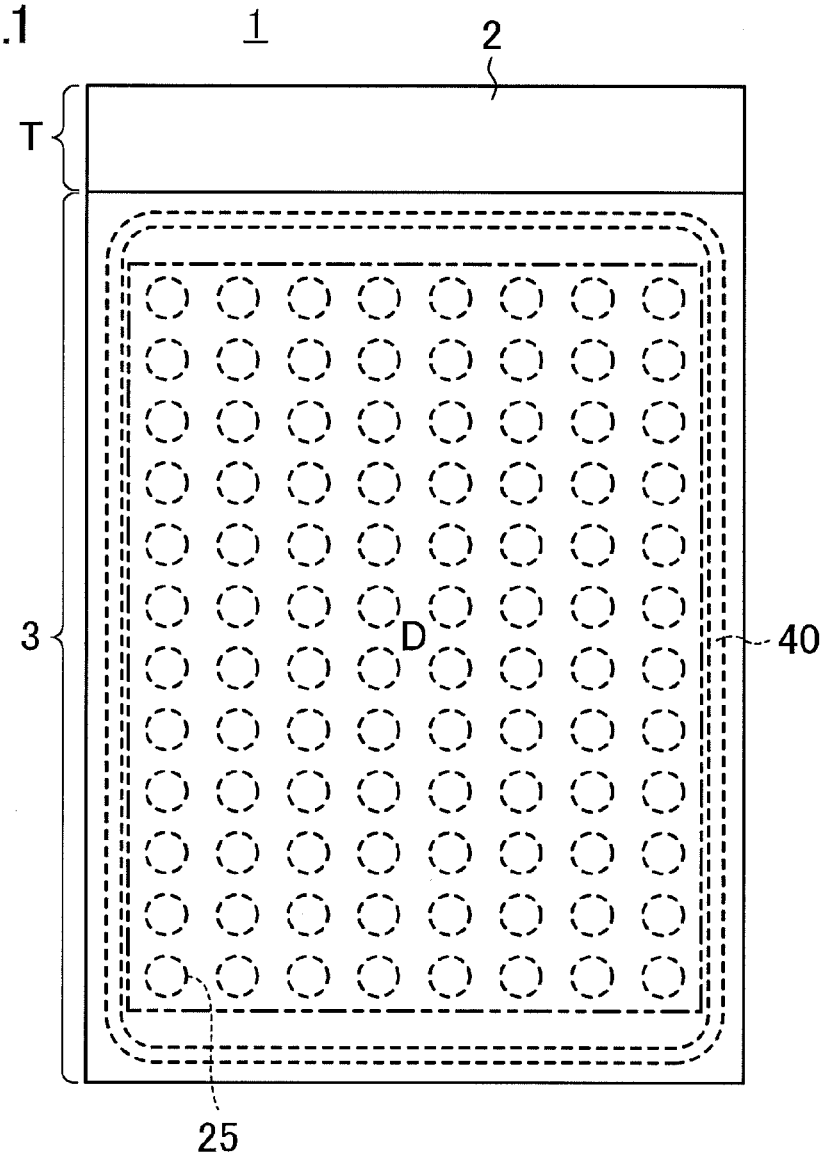
FIG. 1 is a plan view showing the entire configuration of a liquid crystal display device of the first embodiment of the present disclosure.
Figure 2:
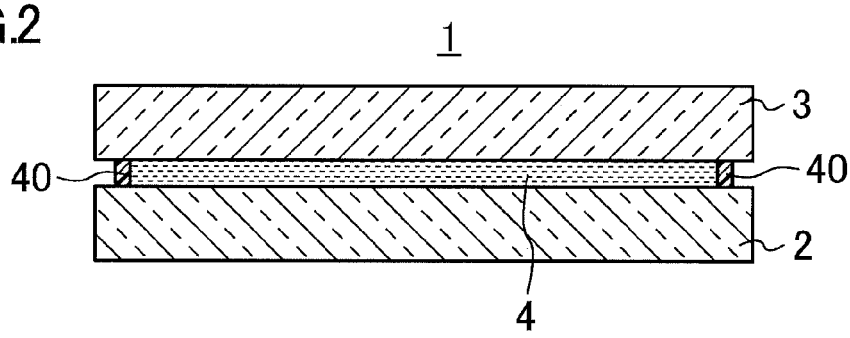
FIG. 2 is a cross-sectional view of the liquid crystal display device of the first embodiment of the present disclosure.
Figure 3:
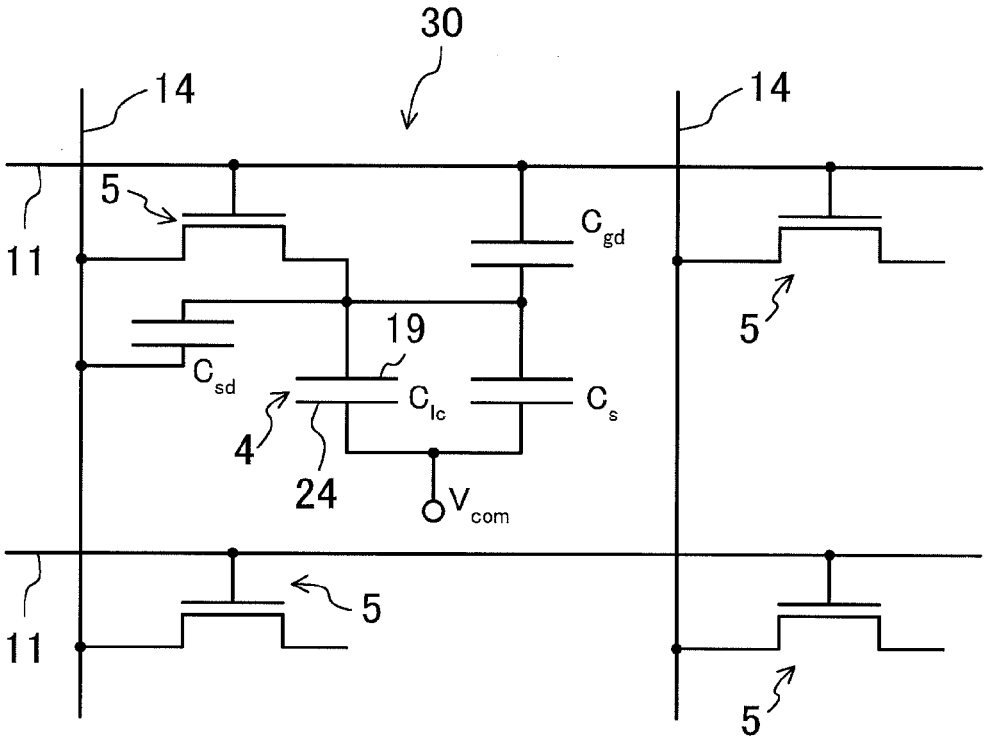
FIG. 3 is an equivalent circuit diagram showing a configuration of a main portion of a pixel of the liquid crystal display device of the first embodiment of the present disclosure.
Figure 4:
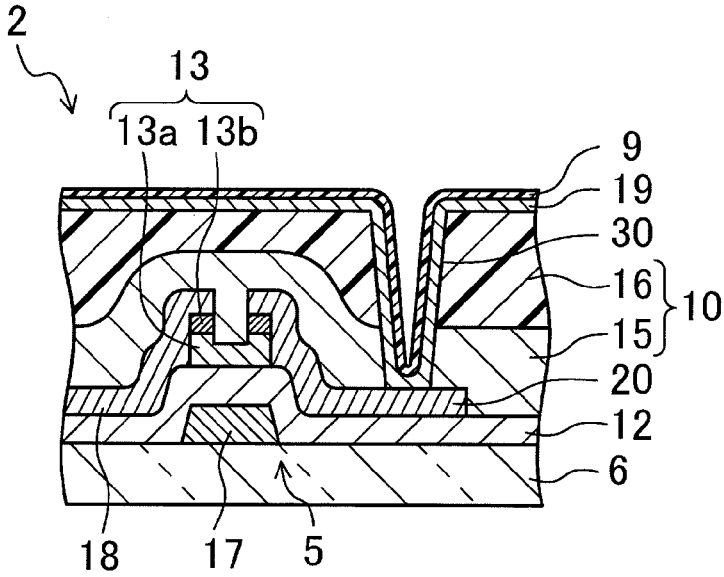
FIG. 4 is a cross-sectional view showing the entire configuration of a TFT substrate constituting the liquid crystal display device of the first embodiment of the present disclosure.
Figure 5:
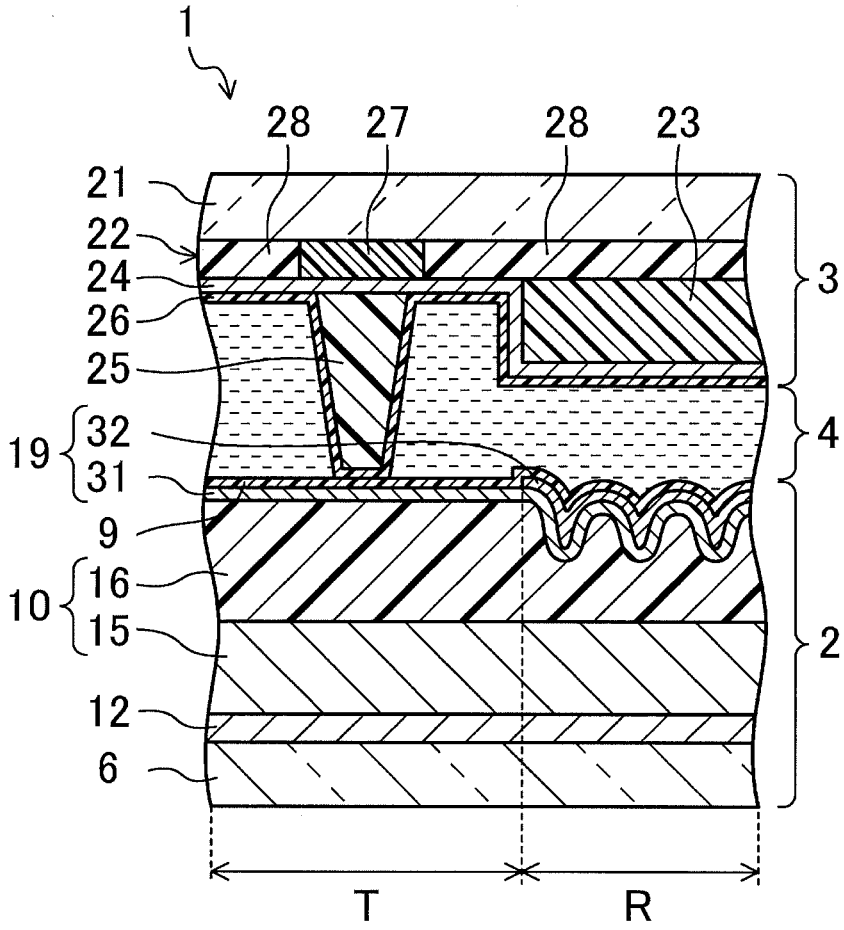
FIG. 5 is a cross-sectional view showing the entire configuration of a display portion of the liquid crystal display device of the first embodiment of the present disclosure.
Figure 6:
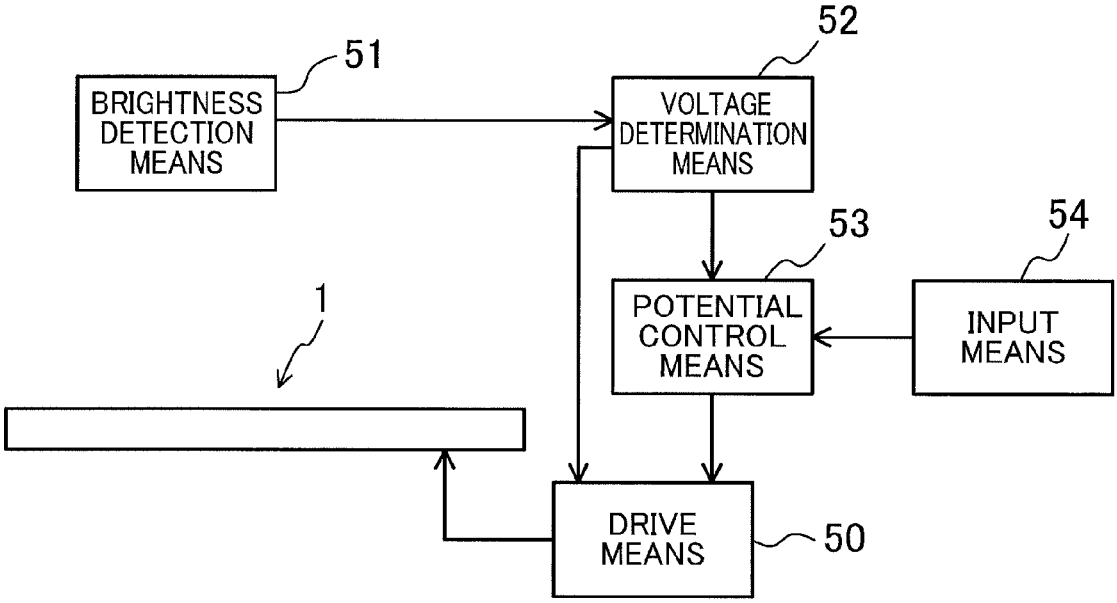
FIG. 6 is a view showing the entire configuration of a device for setting the center voltage of pixel electrodes of the liquid crystal display device of the first embodiment of the present disclosure.

FIG. 1 is a plan view showing the entire configuration of a liquid crystal display device of the first embodiment of the present disclosure, and FIG. 2 is a cross-sectional view of the liquid crystal display device of the first embodiment. FIG. 3 is an equivalent circuit diagram showing a configuration of a main portion of a pixel of the liquid crystal display device of the first embodiment, and FIG. 4 is a cross-sectional view showing the entire configuration of a TFT substrate constituting the liquid crystal display device of the first embodiment. FIG. 5 is a cross-sectional view showing the entire configuration of a display portion of the liquid crystal display device of the first embodiment, and FIG. 6 is a view showing the entire configuration of a device for setting the center voltage of pixel electrodes of the liquid crystal display device of the first embodiment.

As shown in FIGS. 1 and 2, a liquid crystal display device 1 includes a TFT substrate 2 as the first substrate, a CF substrate 3 as the second substrate opposed to the TFT substrate 2, and a liquid crystal layer 4 as a display medium layer sandwiched between the TFT substrate 2 and the CF substrate 3. The liquid crystal display device 1 also includes a sealing member 40 placed in a frame shape to bond the TFT substrate 2 and the CF substrate 3 together and seal the liquid crystal layer 4.

The sealing member 40 surrounds the liquid crystal layer 4, and the TFT substrate 2 and the CF substrate 3 are bonded to each other via the sealing member 40. The liquid crystal display device 1 also includes a plurality of photo spacers 25 for regulating the thickness of the liquid crystal layer 4 (i.e., the cell gap) as shown in FIG. 1.

Also, as shown in FIG. 1, in the liquid crystal display device 1, which has a rectangular shape, the TFT substrate 2 protrudes from the CF substrate 3 in the length direction X of the liquid crystal panel 1 on the upper side as viewed from FIG. 1, and a plurality of interconnects for display such as gate lines and source lines are drawn out into the protruding region, constituting a terminal region T.

In the liquid crystal display device 1, also, an overlap region between the TFT substrate 2 and the CF substrate 3 is defined as a display region D where an image is displayed. The display region D includes a plurality of pixels as the minimum units arranged in a matrix.

The sealing member 40 has a shape of a rectangular frame surrounding the display region D as shown in FIG. 1.

In FIG. 3, each pixel 30 of the liquid crystal display device 1 is formed to correspond to an intersection between a source bus line 14 and a gate bus line 11. In the pixel 30, provided is a thin film transistor (TFT) 5 as a switching element having a gate connected to the gate bus line 11 at a position near the intersection of the two lines, a source connected to the source bus line 14 at a position near the intersection, and a drain connected to a pixel electrode 19. The TFT 5 is on when the gate bus line 11 is in a selected state and off when it is in a non-selected state.

The pixel electrode 19 is connected to the source bus line 14 via the TFT 5, and a common electrode (counter electrode) 24 is opposed to the pixel electrode 19. The liquid crystal layer 4 as the display medium layer is sandwiched between the pixel electrode 19 and the common electrode 24, to constitute a liquid crystal capacitance $C_{lc}$. Also, a storage capacitance $C_s$ is formed in parallel with the liquid crystal capacitance $C_{lc}$. A storage capacitance electrode as one electrode of the storage capacitance $C_s$ is connected to the pixel electrode 19, and a common electrode potential $V_{com}$ is applied to the other electrode thereof, which is the common electrode 24. Moreover, a parasitic capacitance $C_{gd}$ is generated between the gate and drain of the TFT 5.

Note that, although only one pixel portion is shown in FIG. 3, a plurality of source bus lines 14 and a plurality of gate bus lines 11 are provided, and a plurality of pixels 30 are placed in a matrix in correspondence with the intersections between the source bus lines 14 and the gate bus lines 11. In other words, one pixel 30 is provided for each of the regions surrounded by the gate bus lines 11 and the source bus lines 14.

As shown in FIGS. 3 and 4, the TFT substrate 2 includes: an insulating substrate 6 such as a glass substrate; the gate bus lines 11 extending on the insulating substrate 6 in parallel with one another; and a gate insulating film 12 formed to cover the gate bus lines 11. The TFT substrate 2 also includes: the source bus lines 14 extending on the gate insulating film 12 in parallel with one another in the direction orthogonal to the gate bus lines 11; the plurality of TFTs 5 provided for the intersections between the gate bus lines 11 and the source bus lines 14; and a first interlayer insulating film 15 and a second interlayer insulating film 16, which constitute an interlayer insulating film 10, provided sequentially to cover the source bus lines 14 and the TFTs 5. The TFT substrate 2 further includes: the plurality of pixel electrodes 19 formed on the second interlayer insulating film 16 in a matrix and respectively connected to the TFTs 5; and an alignment film 9 formed to cover the pixel electrodes 19.

As shown in FIG. 4, each TFT 5 includes: a gate electrode 17 as a sideways protrusion from the corresponding gate bus line 11; the gate insulating film 12 formed to cover the gate electrode 17; a semiconductor layer 13 formed on the gate insulating film 12 as an island at a position overlapping the gate electrode 17; and a source electrode 18 and a drain electrode 20 formed to face each other on the semiconductor layer 13. The source electrode 18 is a sideways protrusion from the corresponding source bus line 14. The drain electrode 20 is connected to the pixel electrode 19 via a contact hole 30 formed through the first interlayer insulating film 15 and the second interlayer insulating film 16 as shown in FIG. 4. As shown in FIG. 5, the pixel electrode 19 includes: a transparent electrode 31 formed on the second interlayer insulating film 16; and a reflective electrode 32 formed on top of the transparent electrode 31. As shown in FIG. 4, the semiconductor layer 13 includes a lower intrinsic amorphous silicon layer 13*a* and an upper phosphorus-doped $n^+$ amorphous silicon layer 13*b*, and a portion of the intrinsic amorphous silicon layer 13*a* exposed from the source electrode 18 and the drain electrode 20 constitutes a channel region.

In the TFT substrate 2 and the display portion of the liquid crystal display panel 1 having the TFT substrate 2, a reflection region R is defined by the reflective electrode 32, and a transmission region T is defined by the exposed portion of the transparent electrode 31 that is not covered with the reflective electrode 32, as shown in FIG. 5. Also, the surface of the second interlayer insulating film 16 underlying the pixel electrode 19 is roughened as shown in FIG. 5, and the surface of the reflective electrode 32 formed on the roughened surface of the second interlayer insulating film 16 via the transparent electrode 31 is also roughened.

It is not necessarily required to define the reflection region R, but only the transmission region T may be defined.

As shown in FIG. 5, the CF substrate 3 includes: an insulating substrate 21 such as a glass substrate; a color filter layer 22 formed on the insulating substrate 21; and a transparent layer 23 formed in the reflection region R to compensate the light path difference between the reflection region R and the transmission region T. The CF substrate 3 also includes: a common electrode 24 formed to cover the color filter layer 22 in the transmission region T and the transparent layer 23 (in the reflection region R); photo spacers 25 formed on the common electrode 24 like columns; and an alignment film 26 formed to cover the common electrode 24 and the photo spacers 25. The color filter layer 22 includes a coloring layer 28 of a red layer R, a green layer G, or a blue layer B for each pixel and a black matrix 27.

The transflective liquid crystal display panel 1 having the configuration described above reflects light incident from the CF substrate 3 side in the reflection region R, and transmits light of a backlight (not shown) incident from the TFT substrate 2 side.

In the liquid crystal display device 1, a display signal (data signal) corresponding to the display state of each pixel 30 is supplied to the corresponding source bus line 14 from a data signal line drive means (source driver) (not shown), and a scanning signal (gate signal) for turning on/off each TFT 21 is supplied to the corresponding gate bus line 11 from a scanning signal line drive means (gate driver) (not shown).

In the pixel 30 defined for each pixel electrode 19 in the liquid crystal display panel 1, when the gate signal is supplied from the gate bus line 11 to turn on the TFT 5, the data signal is supplied from the source bus line 14 and passes through the source electrode 18 and the drain electrode 20, to allow a predetermined charge to be written into the pixel electrode 19. This causes a potential difference between the pixel electrode 19 and the common electrode 24, resulting in application of a predetermined voltage to the liquid crystal layer 4. In the liquid crystal display device 1, the transmittance of light incident from the backlight is adjusted using the property of liquid crystal molecules that change their aligned state with the magnitude of the applied voltage, thereby displaying an image.

As described earlier, the conventional technique of minimizing flicker by displaying a dot checkered pattern is not necessarily an optimum method. In the conventional method of displaying a dot checkered pattern, an asymmetric voltage (rectangular wave) different in absolute value between the positive voltage and the negative voltage is applied to the liquid crystal layer. In other words, a rectangular wave including an offset voltage is applied, which is likely to cause electrical image sticking.

The potential of the pixel electrode, which is influenced by the potential of the gate bus line, is also influenced by the source bus line. After the gate bus line is turned off, the potential of the source bus line changes, and the potential of the pixel electrode changes with the capacitance between the source and the drain.

In the dot checkered pattern, when a given pixel is high in gray level, an adjoining pixel is 0 or low in gray level and is opposite in polarity. Therefore, the source bus line is in a state that the potential thereof is very large in one of the polarities while being very small in the other, i.e., in a special state that the average voltage thereof is greatly deviated from the common electrode potential $V_{com}$.

In general display, every other dot display like display in the dot checkered pattern is hardly performed, and thus there hardly occurs a situation in which the state that the potential of the source bus line is large in one of the polarities while being small in the other continues. Accordingly, it is considered desirable to set the common electrode potential $V_{com}$ using a solid pattern.

In consideration of the above, in this embodiment, the change in the potential of the source bus line 14 is noted. Specifically, the difference between the center voltage of the potentials of the pixel electrodes 19 set in the dot checkered pattern display and the center voltage of the potentials of the pixel electrodes 19 set in the solid pattern display is determined. Considering this difference, the potential of the common electrode 24 and the center voltage of the potentials of the pixel electrodes 19 are finally made to match with each other.

In comparison between the case of display of a solid pattern of all white (gray level 255) and the case of display of a dot checkered pattern of gray level 255 (display of gray level 0 and gray level 255 alternately every pixel), the center voltage of the potentials of the pixel electrodes 19 adjusted using the dot checkered pattern is higher by:

$$\frac{1}{4}\cdot\frac{C_{sd}}{C_{ls}+C_s+C_{sd}}(V_{H0}+V_{L0}-V_{H255}-V_{L255}) \tag{2}$$

More specifically, when the solid pattern of all white is displayed, it is considered that the change in the potential of the pixel electrode 19 due to the parasitic capacitance $C_{sd}$ formed between the source bus line 14 and the drain of the TFT 5 (pixel electrode) is virtually negligible. Here, let us consider the change in the potential of the source bus line 14 by taking up a potential $V_H$ set in the source bus line 14 to supply a positive potential required to display a given gray level to the pixel electrode 19 and a potential $V_L$ set in the source bus line 14 to supply a negative potential required to display a given gray level to the pixel electrode 19 separately. From $V_H$, the potential is considered to change to the average of $V_H$ and $V_L$ under the dot inversion drive, and the pull-in amount of the potential at this time is:

$$-\frac{C_{sd}}{C_{lc}+C_s}\left(V_H-\frac{1}{2}(V_H+V_L)\right)=-\frac{1}{2}\frac{C_{sd}}{C_{lc}+C_s}(V_H-V_L) \tag{3}$$

From $V_L$, the potential is considered to change to the average of $V_H$ and $V_L$ under the dot inversion drive, and the pull-in amount of the potential at this time is:

$$-\frac{C_{sd}}{C_{lc}+C_s}\left(V_L-\frac{1}{2}(V_H+V_L)\right)=-\frac{1}{2}\frac{C_{sd}}{C_{lc}+C_s}(V_L-V_H) \quad (4)$$

Since the $V_H$ potential drop amount and the $V_L$ potential rise amount are equal to each other from Expressions (3) and (4), the center voltage of the potentials of the pixel electrodes 19 does not change. In other words, in the drive of displaying the solid pattern, it is considered that there is virtually no change in the potential of the pixel electrode 19 due to $C_{sd}$.

Contrarily, the case of display of the dot checkered pattern of gray level 255 (white) is as follows. Assume herein that the potential of the source bus line 14 is represented by $V_{HX}$ (potential set in the source bus line 14 to supply a positive potential required to display gray level X to the pixel electrode 19) or $V_{LX}$ (potential set in the source bus line 14 to supply a negative potential required to display gray level X to the pixel electrode 19) (where X denotes a gray level). In this case, the potential of the source bus line 14 is considered to change from $V_{H255}$ to the average of $V_{H255}$ and $V_{L0}$ under the dot inversion drive, and the pull-in amount of the potential at this time is:

$$-\frac{C_{sd}}{C_{lc}+C_s+C_{sd}}\left(V_{H255}-\frac{1}{2}(V_{H255}+V_{L0})\right)=-\frac{1}{2}\frac{C_{sd}}{C_{lc}+C_s+C_{sd}}(V_{H255}-V_{L0}) \quad (5)$$

From $V_{L255}$, the potential is considered to change to the average of $V_{H0}$ and $V_{L255}$, and the pull-in amount of the potential at this time is:

$$-\frac{C_{sd}}{C_{lc}+C_s+C_{sd}}\left(V_{L255}-\frac{1}{2}(V_{H0}+V_{L255})\right)=-\frac{1}{2}\frac{C_{sd}}{C_{lc}+C_s+C_{sd}}(V_{L255}-V_{H0}) \quad (6)$$

Accordingly, the center voltage of the potentials of the pixel electrodes 19 is deviated by the average of the amounts of Expressions (5) and (6), which is $$\frac{1}{2}\left[\left\{-\frac{1}{2}\frac{C_{sd}}{C_{lc}+C_s+C_{sd}}(V_{H255}+V_{L0})\right\}+\left\{-\frac{1}{2}\frac{C_{sd}}{C_{lc}+C_s+C_{sd}}(V_{L255}-V_{H0})\right\}\right]=\frac{1}{4}\frac{C_{sd}}{C_{lc}+C_s+C_{sd}}(V_{H0}+V_{L0}-V_{H255}-V_{L255}) \quad (7)$$

In other words, the following relationship is established:

$$V_{cenf255}=V_{cen255}+\frac{1}{4}\frac{C_{sd}}{C_{lc}+C_s+C_{sd}}(V_{H0}+V_{L0}-V_{H255}-V_{L255}) \quad (8)$$

where $V_{cenf255}$ is the center voltage of the potentials of the pixel electrodes 19 at the time of display of the dot checkered pattern, and $V_{cen255}$ is the center voltage of the potentials of the pixel electrodes 19 at the time of display of the solid pattern.

In general, the center voltage of the potential of the source bus line 14 for a low gray level, which requires larger pull-in by the gate bus line, is set to be higher than the center voltage of the potential of the source bus line 14 for a high gray level, where $V_{H0}+V_{L0}\geq V_{H255}+V_{L255}$ is often established. Therefore, as represented by Expression (8), the center voltage of the potentials of the pixel electrodes 19 is higher when being set in the dot checkered pattern display than in the solid pattern display.

Thus, the center voltage of the potentials of the pixel electrodes 19 adjusted using the dot checkered pattern in the dot inversion drive is not equal to the optimum value of the center voltage of the potentials of the pixel electrodes 19 adjusted using the solid pattern, and the center voltage of the potentials of the pixel electrodes 19 is not necessarily the optimum value even when it is adjusted using the dot checkered pattern. As a result, an asymmetric voltage may be applied to the liquid crystal layer 4, causing flicker, whereby the display quality may greatly degrade, and also image sticking may occur if the flicker is left unattended for a long time.

Figure 7:
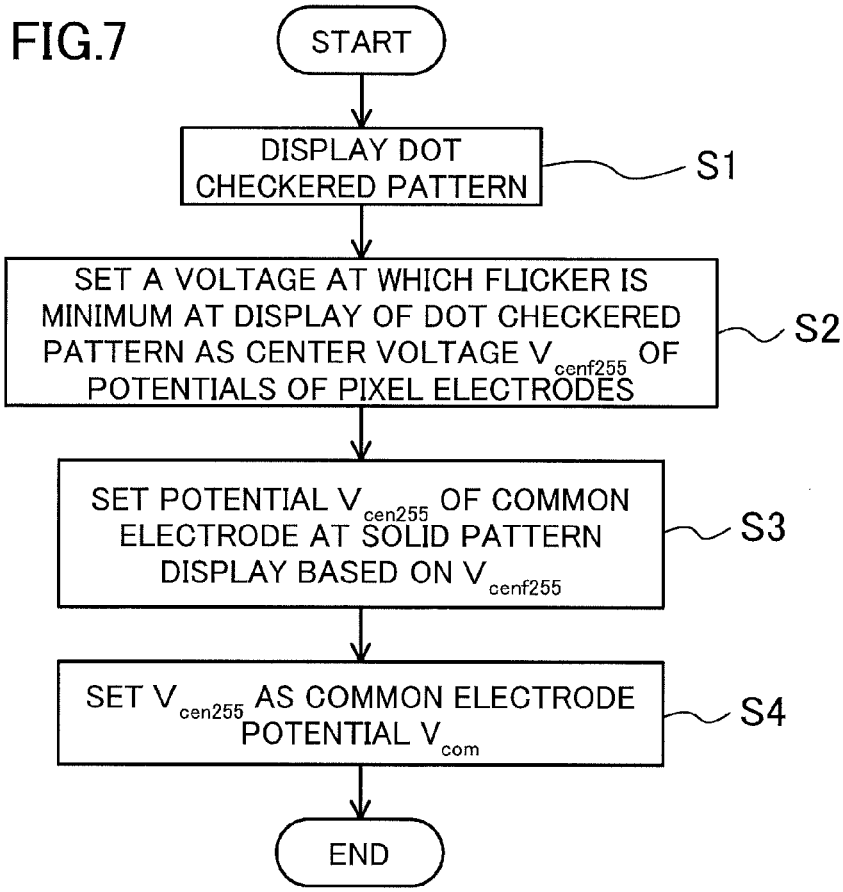
FIG. 7 is a flowchart illustrating a method of setting the center voltage of the potentials of the pixel electrodes of the liquid crystal display device of the first embodiment of the present disclosure.

In this embodiment, the center voltage of the potentials of the pixel electrodes 19 adjusted using the solid pattern is obtained in the following manner. FIG. 7 is a flowchart illustrating a method of setting the center voltage of the potentials of the pixel electrodes in the liquid crystal display device of the first embodiment of the present disclosure.

First, a voltage is applied to the liquid crystal layer 4 by a drive means 50 connected the liquid crystal display device 1 shown in FIG. 6, to display a dot checkered pattern by inverting the polarity of the voltage applied to the liquid crystal layer 4 every adjoining pixel by way of the gate bus lines 11 and the source bus lines 14, where the lowest gray level (i.e., gray level 0) and the highest gray level (i.e., gray level 255) are displayed alternately every pixel (i.e., gray level 0 as black display and gray level 255 as white display are displayed alternately every pixel) (step S1).

Subsequently, while the dot checkered pattern is kept displayed, the voltage at which flicker is minimum is set as the center voltage $V_{cenf255}$ of the potentials of the pixel electrodes 19 (step S2).

More specifically, the brightness of the liquid crystal display device 1 is detected by a brightness detection means 51 (e.g., a photodiode, etc.) shown in FIG. 6. Subsequently, a voltage determination means 52 (e.g., a spectral analyzer, a flicker meter, etc.), which receives the detected brightness data and data of the voltage applied to the liquid crystal layer 4, determines the potential at which flicker is minimum (i.e., the brightness difference between the light and dark times is minimum).

The flicker is minimized by setting the potential of the common electrode 24 to be equal to the center voltage $V_{cenf255}$ of the potentials of the pixel electrodes 19. Therefore, while the dot checkered pattern is kept displayed, the potential of the common electrode 24 at which flicker is minimum is set to be equal to the center voltage $V_{cenf255}$ of the potentials of the pixel electrodes 19, and, according to Expression (8) above, while the dot checkered pattern is kept displayed, a voltage (i.e., $V_{cen255}$) obtained by reducing the voltage $V_{cenf255}$ of the common electrode 24 at which flicker is minimum by $$\frac{1}{4}\cdot\frac{C_{sd}}{C_{lc}+C_s+C_{sd}}(V_{H0}+V_{L0}-V_{H255}-V_{L255})$$

is set as the potential of the common electrode 24 at the time of solid pattern display (i.e., display of gray level 255 for all the plurality of pixels 30) (step S3).

More specifically, a potential control means 53 for controlling the potentials of the pixel electrodes 19 and the common electrode 24 receives data of the voltage determined by the voltage determination means 52, and sets the received data as the center voltage $V_{cenf255}$ of the potentials of the pixel electrodes 19. Moreover, while the dot checkered pattern is kept displayed, the potential control means 53 sets a voltage obtained by reducing the voltage $V_{cenf255}$ of the common electrode 24 at which flicker is minimum by $$\frac{1}{4}\cdot\frac{C_{sd}}{C_{lc}+C_s+C_{sd}}(V_{H0}+V_{L0}-V_{H255}-V_{L255})$$

as the potential $V_{cen255}$ of the common electrode 24 at the time of solid pattern display.

Then, the potential $V_{cen255}$ of the common electrode 24 is set as the common electrode potential $V_{com}$ (step S4).

More specifically, data of the set potential $V_{cen255}$ of the common electrode 24 at the time of solid pattern display is output to the drive means 50, and the drive means 50 applies the potential $V_{cen255}$ of the common electrode 24 as the common electrode potential $V_{com}$.

As described above, considering the difference from the center voltage $V_{cenf255}$ of the potentials of the pixel electrodes 19 (i.e., the voltage of the common electrode 24) set in the dot checkered pattern display, the potential $V_{cen255}$ of the common electrode 24 and the center voltage $V_{cen255}$ of the potentials of the pixel electrodes 19 in the solid pattern display can be made to match with each other (i.e., the center voltage $V_{cen255}$ of the potentials of the pixel electrodes 19 at the time of solid pattern display and the common electrode potential $V_{com}$ can be made to match with each other). Therefore, a symmetric voltage can be applied to the liquid crystal layer, and thus degradation in display quality can be prevented, and also occurrence of image sticking can be prevented.

(Second Embodiment)

The second embodiment of the present disclosure will be described. Note that the entire configuration of the liquid crystal display device, the entire configuration of the TFT substrate, and the entire configuration of the device for setting the center voltage of the pixel electrodes in the liquid crystal display device are similar to those described in the first embodiment, and thus detailed description of these configurations are omitted here.

While the common electrode voltage $V_{com}$ was set based on Expression (8) in the first embodiment, the actual value of the parasitic capacitance $C_{sd}$ does not necessarily match with the design value thereof due to variations in size, etc.

Also, in general, in the case of a halftone, compared with the case of gray level 255, the brightness changes largely with a slight potential difference even in solid pattern display, and thus detection of flicker is facilitated.

In view of the above, in this embodiment, the parasitic capacitance $C_{sd}$ is deleted, and the common electrode voltage $V_{com}$ is set using the center voltage of the potentials of the pixel electrodes for a halftone, in Expression (8) above.

More specifically, first, $$V_{cenfx}=V_{cenx}+\frac{1}{4}\frac{C_{sd}}{C_{lcx}+C_s+C_{sd}}(V_{H0}+V_{L0}-V_{Hx}-V_{Lx}) \tag{9}$$

is established for a gray level X from Expression (8) above.

By substituting $\Delta V_{cenx}=V_{cenx}-V_{cenfx}$ and $v_x=-(V_{H0}+V_{L0}-V_{Hx}-V_{Lx})$ into Expression (9) above, $$\frac{v_x}{\Delta V_{cenx}}=4\cdot\frac{C_{lcx}+C_s+C_{sd}}{C_{sd}}=4\cdot\left(\frac{C_{lcx}+C_s}{C_{sd}}+1\right) \tag{10}$$

is obtained.

When Expression (10) is applied to gray levels a and b as arbitrary halftones (i.e., gray levels a and b that are arbitrary halftones obtained when black display is defined as gray level 0 and white display as gray level 255 and the brightness therebetween is divided into 254 levels), $$\frac{v_a}{\Delta V_{cen_a}}-\frac{v_b}{\Delta V_{cen_b}}=4\cdot\left(\frac{C_{lc_a}+C_s}{C_{sd}}+1\right)-4\cdot\left(\frac{C_{lc_b}+C_s}{C_{sd}}+1\right)=4\cdot\frac{C_{lc_a}}{C_{sd}}\left(1-\frac{C_{lc_b}}{C_{lc_a}}\right) \tag{11}$$

is obtained.

Equation (11) can be transposed to $$4\cdot\frac{C_{lc_a}}{C_{sd}}=\frac{\frac{v_a}{\Delta V_{cen_a}}-\frac{v_b}{\Delta V_{cen_b}}}{1-\frac{C_{lc_b}}{C_{lc_a}}} \tag{12}$$

Likewise, when Expression (10) is applied to a given halftone a and gray level 255, $$\frac{v_{255}}{\Delta V_{cen_{255}}}-\frac{v_a}{\Delta V_{cen_a}}=4\cdot\frac{C_{lc_{255}}}{C_{sd}}\left(1-\frac{C_{lc_a}}{C_{lc_{255}}}\right)=4\cdot\frac{C_{lc_a}}{C_{sd}}\cdot\frac{C_{lc_{255}}}{C_{lc_a}}\cdot\left(1-\frac{C_{lc_a}}{C_{lc_{255}}}\right) \tag{13}$$

is obtained.

From Equations (12) and (13), $$\Delta V_{cen255}=\frac{v_{255}}{4\cdot\frac{C_{lc_a}}{C_{sd}}\cdot\frac{C_{lc_{255}}}{C_{lc_a}}\cdot\left(1-\frac{C_{lc_a}}{C_{lc_{255}}}\right)+\frac{v_a}{\Delta V_{cen_a}}}=\frac{v_{255}}{\frac{\frac{v_a}{\Delta V_{cen_a}}-\frac{v_b}{\Delta V_{cen_b}}}{1-\frac{C_{lc_b}}{C_{lc_a}}}\cdot\frac{C_{lc_{255}}}{C_{lc_a}}\cdot\left(1-\frac{C_{lc_a}}{C_{lc_{255}}}\right)+\frac{v_a}{\Delta V_{cen_a}}}$$

$$=\frac{v_{255}}{\left(\frac{v_a}{\Delta V_{cen_a}}-\frac{v_b}{\Delta V_{cen_b}}\right)\cdot\frac{C_{lc_{255}}-C_{lc_a}}{C_{lc_a}-C_{lc_b}}+\frac{v_a}{\Delta V_{cen_a}}}=\frac{v_{255}}{\left(\frac{v_a}{\Delta V_{cen_a}}-\frac{v_b}{\Delta V_{cen_b}}\right)\cdot C_{lc_{255}}\cdot\frac{1-\frac{C_{lc_a}}{C_{lc_{255}}}}{\frac{C_{lc_a}}{C_{lc_{255}}}-\frac{C_{lc_b}}{C_{lc_{255}}}}+\frac{v_a}{\Delta V_{cen_a}}} \tag{14}$$

is obtained.

Accordingly, from Equation (14) and $\Delta V_{cenx}=V_{cenx}-V_{cenfx}$, $$V_{cen255}=V_{cenf255}+\Delta V_{cen255} \tag{15}$$

is obtained. Thus, the center voltage of the potentials of the pixel electrodes 19 adjusted in a solid pattern can be determined using the center voltage of the potentials of the pixel electrodes 19 for a halftone without use of the parasitic capacitance $C_{sd}$.

Then, as in the first embodiment, since the flicker becomes minimum by setting the potential of the common electrode 24 to be equal to the center voltage of the potentials of the pixel electrodes 19, the potential of the common electrode 24 at which the flicker is minimum is set to be equal to the center voltage of the potentials of the pixel electrodes 19.

Figure 8:
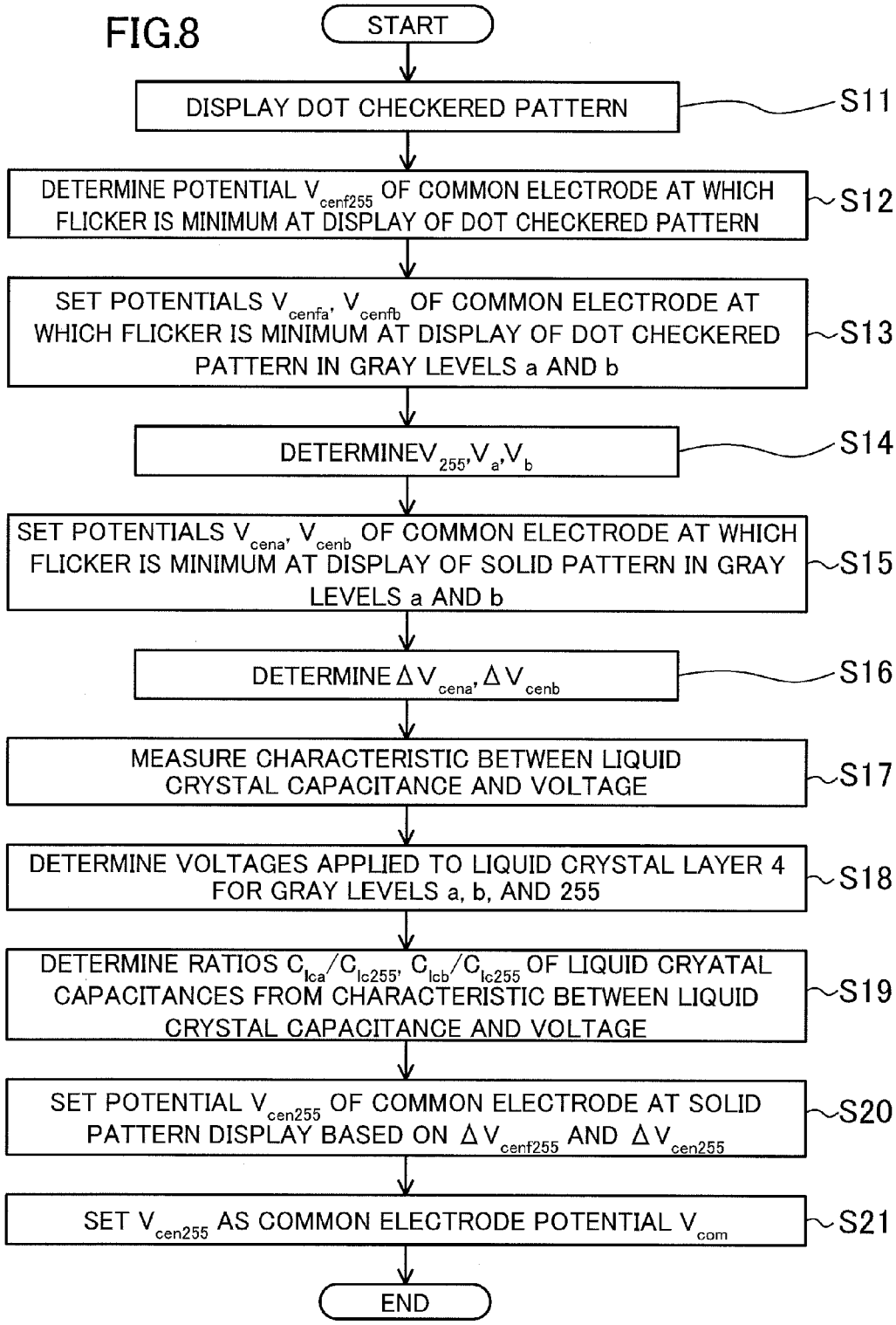
FIG. 8 is a flowchart illustrating a method of setting the center voltage of the potentials of the pixel electrodes of a liquid crystal display device of the second embodiment of the present disclosure.

Next, a method of setting the center voltage of the potentials of the pixel electrodes 19 adjusted using the solid pattern in this embodiment will be described. FIG. 8 is a flowchart illustrating the method of setting the center voltage of the potentials of the pixel electrodes in the liquid crystal display device of the second embodiment of the present disclosure.

First, as in the first embodiment described above, a voltage is applied to the liquid crystal layer 4 by the drive means 50, to display a dot checkered pattern by inverting the polarity of the voltage applied to the liquid crystal layer 4 every adjoining pixel by way of the gate bus lines 11 and the source bus lines 14, where the lowest gray level (i.e., gray level 0) and the highest gray level (i.e., gray level 255) are displayed alternately every pixel (step S11).

Then, as in the first embodiment described above, while the dot checkered pattern is kept displayed, the potential of the common electrode 24 at which flicker is minimum is determined, and the determined potential is set as $V_{cenf255}$ (step S12).

Thereafter, gray levels a and b as given halftones are displayed in place of the highest gray level (i.e., gray level 255) in the step S11 described above, and processing similar to that in the step S12 described above is performed, to determine potentials at which flicker is minimum, and the determined potentials are set as $V_{cenfa}$ and $V_{cenfb}$, respectively (step S13).

More specifically, gray level 0 and gray level a as a given halftone are displayed alternately every pixel, and while gray level 0 and gray level a are kept displayed, the voltage at which flicker is minimum is set as the potential $V_{cenfa}$ of the common electrode 24. Likewise, gray level 0 and gray level b as a given halftone are displayed alternately every pixel, and while gray level 0 and gray level b are kept displayed, the voltage at which flicker is minimum is set as the potential $V_{cenfb}$ of the common electrode 24.

In the above case, as in the first embodiment, the brightness of the liquid crystal display device 1 is detected by the brightness detection means 51. Subsequently, the voltage determination means 52, which receives the detected brightness data and data of the voltage applied to the liquid crystal layer 4, determines the potential of the common electrode 24 at which flicker is minimum (i.e., the brightness difference between the light and dark times is minimum).

Thereafter, $\nu_{255}$, $\nu_a$, and $\nu_b$ in gray levels 255, a, and b, respectively, are determined using $\nu_x=-(V_{H0}+V_{L0}-V_{Hx}-V_{Lx})$ (step S14).

Subsequently, solid patterns in gray levels a and b as given halftones are displayed by the drive means 50, and, while the solid patterns in gray levels a and b are kept displayed, the potentials at which flicker is minimum are determined and set as potentials $V_{cena}$ and $V_{cenb}$, respectively (step S15).

More specifically, gray level a is displayed for all the plurality of pixels 30, and while gray level a is kept displayed for all the pixels 30, the voltage at which flicker is minimum is set as the potential $V_{cena}$ of the common electrode 24. Likewise, gray level b is displayed for all the pixels 30, and while gray level b is kept displayed for all the pixels 30, the voltage at which flicker is minimum is set as the potential $V_{cenb}$ of the common electrode 24.

In the above case, also, as in the first embodiment, the brightness of the liquid crystal display device 1 is detected by the brightness detection means 51. Subsequently, the voltage determination means 52, which receives the detected brightness data and data of the voltage applied to the liquid crystal layer 4, determines the potential of the common electrode 24 at which flicker is minimum (i.e., the brightness difference between the light and dark times is minimum).

Thereafter, $\Delta V_{cena}$ and $\Delta V_{cenb}$ in gray level a and gray level b are determined based on $\Delta V_{cenx}=V_{cenx}-\Delta V_{cenfx}$ (step S16).

Subsequently, a liquid crystal display cell is prepared separately to determine the liquid crystal capacitances $C_{lca}$, $C_{lcb}$, and $C_{lc255}$ in Expression (14), and the characteristic between the liquid crystal capacitance and the voltage applied to the liquid crystal layer 4 (C-V characteristic) is measured (step S17).

Figure 9:
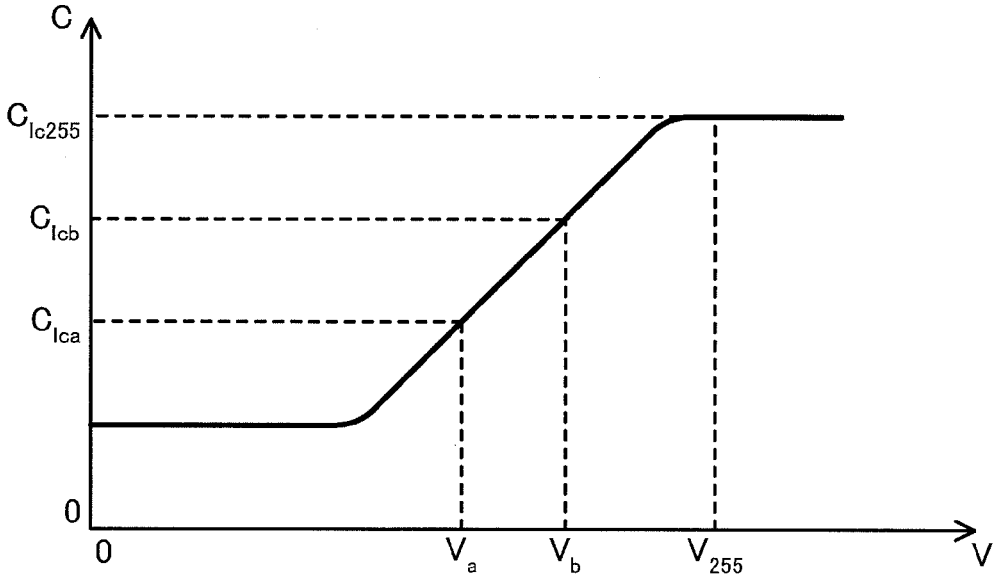
FIG. 9 is a view showing an example of the characteristic between the liquid crystal capacitance and the voltage (C-V characteristic).

More specifically, a liquid crystal display device 1 having a pixel size of 1 cm×1 cm, for example, is prepared, and the characteristic between the liquid crystal capacitance and the voltage (C-V characteristic) is measured using an LCR meter and an impedance measurement device. FIG. 9 shows an example of the liquid crystal capacitance-voltage characteristic (C-V characteristic).

The liquid crystal capacitance-voltage characteristic may otherwise be measured by liquid crystal alignment calculation. More specifically, first, the dielectric constant, the elastic modulus, and the pretilt angle as physical values of the liquid crystal are set, and one-directional calculation of the liquid crystal alignment at an applied voltage is performed changing the voltage from 0 V to the white voltage (in normally black display) in steps of a predetermined value. Thereafter, the liquid crystal capacitance and the transmittance are determined based on the calculated liquid crystal alignment, to determine the liquid crystal capacitance-voltage characteristic (C-V characteristic).

Thereafter, voltages $V_a$, $V_b$, and $V_{255}$ applied to the liquid crystal layer 4 are determined for gray levels a, b, and 255, respectively (step S18).

More specifically, in Expression (16) below that is a relational expression between the brightness and the gray level, value γ indicating the relationship between the brightness and the input signal is set at a predetermined value (e.g., γ=2.2 for TV sets). Thereafter, the brightness in gray level a and that in gray level b, with respect to the brightness in gray level 255 that is 1, are calculated from Expression (16), and then the voltages in gray levels a, b, and 255 are determined from the characteristic between the brightness and the voltage (V-T characteristic).

$$y=\alpha x^{\gamma} \tag{16}$$

where y is the brightness, x is the gray level, and a is a constant.

Assuming that the brightness is $y_{255}$ when gray level x is 255, the constant α is $\alpha=y_{255}\cdot 255^{-\gamma}$.

Subsequently, based on the measured C-V characteristic, the liquid crystal capacitances $C_{lca}$, $C_{lcb}$, and $C_{lc255}$ are determined from the capacitances corresponding to the voltages for gray levels a, b, and 255, and also the capacitance ratios $C_{lca}/C_{lc255}$ and $C_{lcb}/C_{lc255}$ are determined (step S19).

More specifically, as shown in FIG. 9, the liquid crystal capacitances $C_{lca}$, $C_{lcb}$, and $C_{lc255}$ in gray levels a, b, and 255 are determined based on the voltages $V_a$, $V_b$, and $V_{255}$ applied to the liquid crystal layer 4 in gray levels a, b, and 255, respectively, and the characteristic between the liquid crystal capacitance and the voltage applied to the liquid crystal layer 4 (C-V characteristic) described above, and also the capacitance ratios $C_{lca}/C_{lc255}$ and $C_{lcb}/C_{lc255}$ are determined.

The potential control means 53 then receives the voltage data (i.e., $V_{cenfa}$, $V_{cenfb}$, $V_{cena}$, and $V_{cenb}$) determined by the voltage determination means 52, and also receives $v_{255}$, $v_a$, $v_b$, $C_{lca}$, $C_{lcb}$, $C_{lc255}$, $C_{lca}/C_{lc255}$ and $C_{lcb}/C_{lc255}$ from the input means 54 (e.g., a personal computer) connected to the potential control means 53.

Thus, since the potential control means 53 can determine $\Delta V_{cen255}$ in Expression (14), it can set the potential $V_{cen255}$ of the common electrode 24 at the time of solid pattern display based on $V_{cenf255}+\Delta V_{cen255}$ from Expression (15) (step 20).

In other words, the potential control means 53 sets a voltage obtained by adding $$\frac{v_{255}}{\left(\frac{v_a}{\Delta V_{cen_a}} - \frac{v_b}{\Delta V_{cen_b}}\right)\cdot C_{lc_{255}}\cdot\frac{1-\frac{C_{lc_a}}{C_{lc_{255}}}}{\frac{C_{lc_a}}{C_{lc_{255}}}-\frac{C_{lc_b}}{C_{lc_{255}}}}+\frac{v_a}{\Delta V_{cen_a}}}$$

to $V_{cenf255}$ as $V_{cen255}$.

The set potential $V_{cen255}$ of the common electrode 24 at the time of solid pattern display is set as the common electrode potential $V_{com}$ (step S21).

In other words, data of the set potential $V_{cen255}$ of the common electrode 24 at the time of solid pattern display is output to the drive means 50, and the drive means 50 applies the potential $V_{cen255}$ as the common electrode voltage $V_{com}$. As described above, considering the difference from the center voltage $V_{cenf255}$ of the potentials of the pixel electrodes 19 (i.e., the voltage of the common electrode 24) set in dot checkered pattern display, the potential $V_{cen255}$ of the common electrode 24 and the center voltage $V_{cen255}$ of the potentials of the pixel electrodes 19 at the time of solid pattern display can be made to match with each other (i.e., the center voltage $V_{cen255}$ of the potentials of the pixel electrodes 19 at the time of solid pattern display and the common electrode voltage $V_{com}$ can be made to match with each other). Therefore, a symmetric voltage can be applied to the liquid crystal layer, and thus degradation in display quality can be prevented, and also occurrence of image sticking can be prevented.

Also, since the potential of the common electrode 24 at the time of solid pattern display can be set without use of the parasitic capacitance of which the actual value does not necessarily match with its design value, the potential $V_{com255}$ of the common electrode 24 and the center voltage of the potentials of the pixel electrodes 19 can be made to match with each other further precisely.

(Third Embodiment)

The third embodiment of the present disclosure will be described. Note that the entire configuration of the liquid crystal display device, the entire configuration of the TFT substrate, and the entire configuration of the device for setting the center voltage of the pixel electrodes in the liquid crystal display device are similar to those described in the first embodiment, and thus detailed description of these configurations are omitted here. Note also that in this embodiment the potential control means 53 described above functions as a means for controlling the voltage of the common electrode.

As discussed in the first embodiment, it is desirable to set the common electrode potential $V_{com}$ using a solid pattern (e.g., all white in gray level 255). However, since flicker is small in solid pattern display, setting of the common electrode potential $V_{com}$ is not easy. In particular, in white display, where the brightness hardly changes, detection of flicker is sometimes difficult.

To solve the above problem, in this embodiment, while a solid pattern of a gray level close to level 255 is being displayed, a voltage at which flicker is minimum is set as the common electrode potential $V_{com}$ (i.e., the center voltage $V_{cenf255}$ of the potentials of the pixel electrodes).

Figure 10:
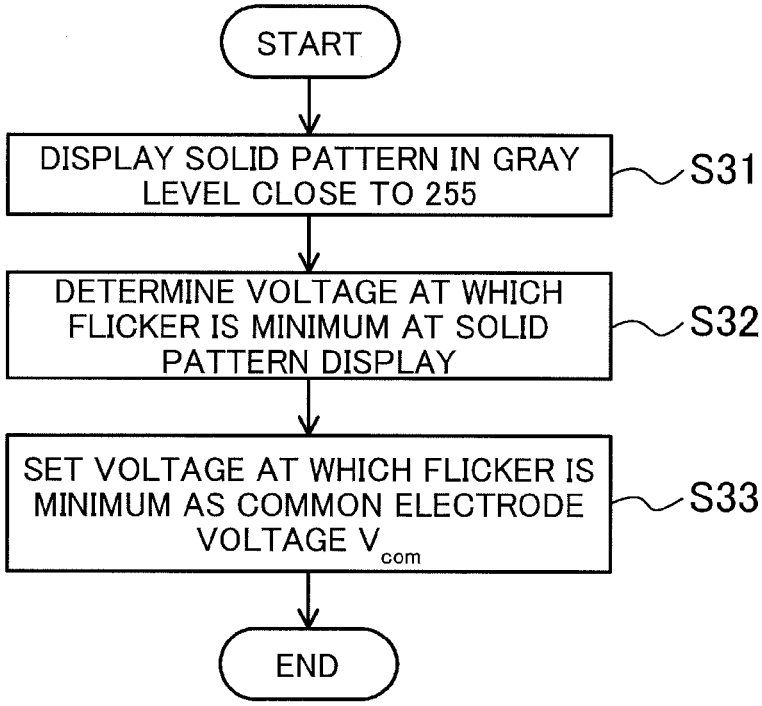
FIG. 10 is a flowchart illustrating a method of setting a common electrode voltage in a liquid crystal display device of the third embodiment of the present disclosure.

FIG. 10 is a flowchart illustrating a method of setting the common electrode voltage in a liquid crystal display device of the third embodiment of the present disclosure.

First, a voltage is applied to the liquid crystal layer 4 by the drive means 50 connected to the liquid crystal display device 1, to display a solid pattern of a gray level close to gray level 255 (e.g., gray level 245) (step S31).

Thereafter, while the solid pattern is kept displayed, the brightness of the liquid crystal display device 1 is detected by the brightness detection means 51. The voltage determination means 52, which receives the detected brightness data and the voltage data applied to the liquid crystal layer 4, determines the voltage at which flicker is minimum (i.e., the brightness difference between the light and dark times is minimum) (step S32).

The determined voltage is set as the common electrode voltage $V_{com}$ (step S33).

More specifically, the voltage control means 53 for controlling the voltage of the common electrode 24 receives the voltage data determined by the voltage determination means 52, and sets the received voltage as the common electrode voltage $V_{com}$.

The data of the set common electrode voltage $V_{com}$ is output to the drive means 50, and the drive means 50 applies the common electrode voltage $V_{com}$ to the liquid crystal layer 4.

As described above, while detection of flicker is easy, the center voltage $V_{cen255}$ of the potentials of the pixel electrodes at the time of solid pattern display and the common electrode voltage $V_{com}$ can be made to match with each other, and a symmetric voltage can be applied to the liquid crystal layer 4. Thus, degradation in display quality can be prevented, and also occurrence of image sticking can be prevented.

Figure 11:
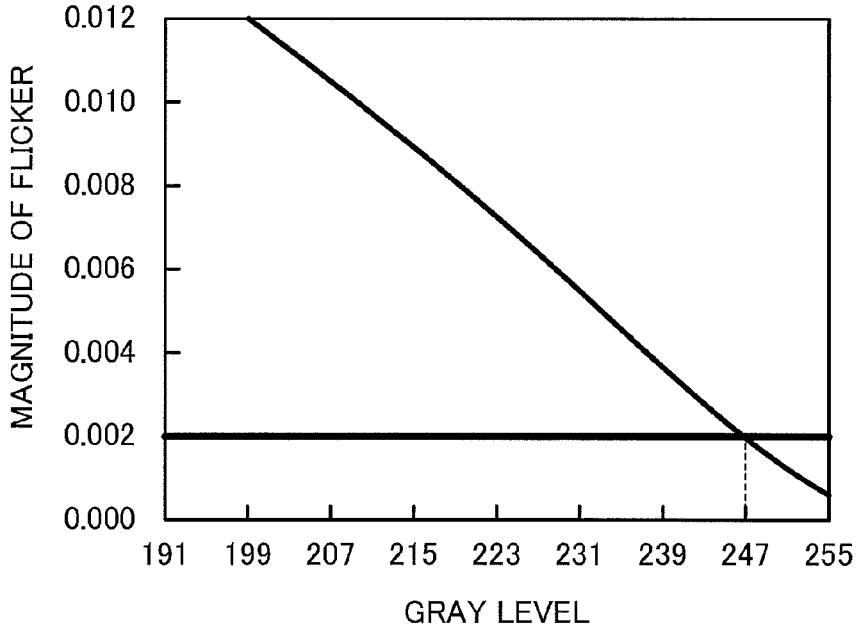
FIG. 11 is a view showing the relationship between the magnitude of flicker and the gray level.
Figure 12:
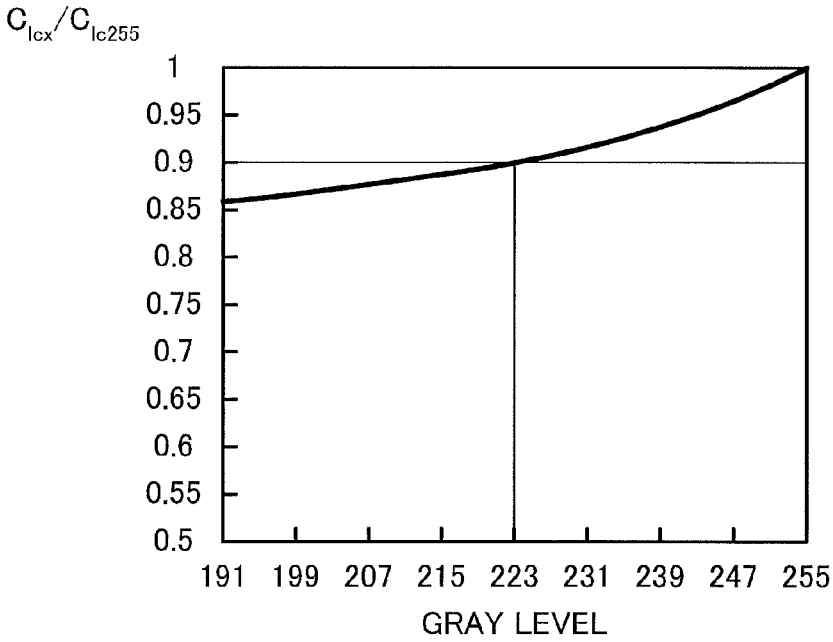
FIG. 12 is a view showing the relationship between the liquid crystal capacitance and the gray level.
Figure 13:
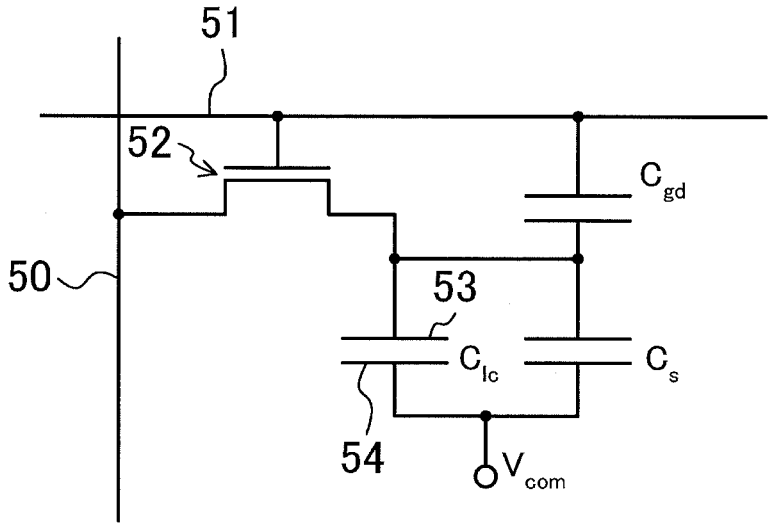
FIG. 13 is an equivalent circuit diagram showing a configuration of a main portion of a pixel of a conventional liquid crystal display device.

In this embodiment, a solid pattern of a gray level close to level 255, which is in the range of gray level 223 to gray level 247, is displayed. If the gray level is higher than 247, the flicker is large compared with the case of gray level 255 but may not be large enough to facilitate detection of flicker, as shown in FIG. 11. In other words, to facilitate detection of flicker, it is necessary to use a gray level equal to or lower than 247 where the magnitude of flicker is 0.002 or more, as shown in FIG. 11. If the gray level is lower than 223, the liquid crystal capacitance becomes largely different from the case of gray level 255 (i.e., the liquid crystal capacitance is small compared with the case of gray level 255). Therefore, setting of an appropriate common electrode potential $V_{com}$ may become difficult. In other words, to set an appropriate common electrode potential $V_{com}$, it is necessary to use a gray level equal to or higher than 223 where the ratio between liquid crystal capacitances $C_{lcx}$ and $C_{lc255}$ in a given gray level x and gray level 255 ($C_{lcx}/C_{lc255}$) is 0.9 or more.

Industrial Applicability

The present disclosure can be applied to an active matrix liquid crystal display device using switching elements such as thin film transistors and a potential setting method for the same.

DESCRIPTION OF REFERENCE CHARACTERS

1 Liquid Crystal Display Device
2 TFT Substrate

3 CF Substrate
4 Liquid Crystal Layer
5 TFT (Switching Element)
11 Gate Bus Line (Scanning Signal Line)
14 Source Bus Line (Data Signal Line)
19 Pixel Electrode
24 Common Electrode
30 Pixel
50 Drive Means
51 Brightness Detection Means
52 Voltage Determination Means
53 Potential Control Means (Potential Control Section)
54 Input Means

The invention claimed is:

1. A liquid crystal display device, comprising:

a plurality of data signal lines;

a plurality of scanning signal lines intersecting with the plurality of data signal lines;

a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode; and a potential control section configured to control the potential of the common electrode, wherein when $C_{sd}$ is a parasitic capacitance formed between the data signal line and a drain of the switching element, $C_{lc}$ is a liquid crystal capacitance, $C_s$ is a storage capacitance, gray level 0 denotes black display, and gray level 255 denotes white display, when, in the case of alternate display of gray level 0 and gray level 255 every pixel, $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{H255}$ is a potential set for the data signal line to apply a positive potential required for display of gray level 255 to the pixel electrode, $V_{L255}$ is a potential set for the data signal line to apply a negative potential required for display of gray level 255 to the pixel electrode, and $V_{cenf255}$ is a potential of the common electrode at which flicker is minimum, and when, in the case of display of gray level 255 for all the plurality of pixels, $V_{cen255}$ is a potential of the common electrode at which flicker is minimum, the potential control section sets a potential obtained by reducing $V_{cenf255}$ by $$\frac{1}{4}\cdot\frac{C_{sd}}{C_{lc}+C_s+C_{sd}}(V_{H0}+V_{L0}-V_{H255}-V_{L255})$$

as $V_{cen255}$.

2. A liquid crystal display device, comprising:

a plurality of data signal lines;

a plurality of scanning signal lines intersecting with the plurality of data signal lines;

a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected selected, a pixel electrode connected to the corresponding data signal line via the switching element, a common electrode opposed to the pixel electrode, and a liquid crystal layer sandwiched between the pixel electrode and the common electrode; and a potential control section configured to control the potential of the common electrode, wherein when $C_{lca}$, $C_{lcb}$, and $C_{lc255}$ are respectively liquid crystal capacitances in gray level a, gray level b, and gray level 255, gray levels a and b being two arbitrary halftones obtained when black display is defined as gray level 0 and white display as gray level 255 and the brightness therebetween is divided into 254 levels, when $\upsilon_a=-(V_{H0}+V_{L0}-V_{Ha}-V_{La})$, $\upsilon_b=-(V_{H0}+V_{L0}-V_{Hb}-V_{Lb})$, and $\upsilon_{255}=-(V_{H0}+V_{L0}-V_{H255}-V_{L255})$ are defined where $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{Ha}$ is a potential set for the data signal line to apply a positive potential required for display of gray level a to the pixel electrode, $V_{La}$ is a potential set for the data signal line to apply a negative potential required for display of gray level a to the pixel electrode, $V_{Hb}$ is a potential set for the data signal line to apply a positive potential required for display of gray level b to the pixel electrode, $V_{Lb}$ is a potential set for the data signal line to apply a negative potential required for display of gray level b to the pixel electrode, $V_{H255}$ is a potential set for the data signal line to apply a positive potential required for display of gray level 255 to the pixel electrode, and $V_{L255}$ is a potential set for the data signal line to apply a negative potential required for display of gray level 255 to the pixel electrode, and when $\Delta V_{cena}=V_{cena}-V_{cenfa}$ and $\Delta V_{cenb}=V_{cenb}-V_{cenfb}$ are defined where $V_{cenfa}$ is a potential of the common electrode at which flicker is minimum in the case of alternate display of gray level 0 and gray level a every pixel, $V_{cenfb}$ is a potential of the common electrode at which flicker is minimum in the case of alternate display of gray level 0 and gray level b every pixel, and $V_{cena}$ and $V_{cenb}$ are potentials of the common electrode at which flicker is minimum in the case of display of gray level a and gray level b, respectively, for all the plurality of pixels, the potential control section sets a potential obtained by adding $$\frac{v_{255}}{\left(\frac{v_a}{\Delta V_{cen_a}}-\frac{v_b}{\Delta V_{cen_b}}\right)\cdot C_{lc_{255}}\cdot\frac{1-\frac{C_{lc_a}}{C_{lc_{255}}}}{\frac{C_{lc_a}}{C_{lc_{255}}}-\frac{C_{lc_b}}{C_{lc_{255}}}}+\frac{v_a}{\Delta V_{cen_a}}}$$

to $V_{cenf255}$ as $V_{cen255}$.

3. A potential setting method for a liquid crystal display device including a plurality of data signal lines, a plurality of scanning signal lines intersecting with the plurality of data signal lines, and a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode, the method at least comprising the steps of:

displaying gray level 0 as black display and gray level 255 as white display alternately every pixel;

setting a voltage at which flicker is minimum during the alternate display of gray level 0 and gray level 255 every pixel as a center voltage $V_{cenf255}$ of the potential of the common electrode; and setting a potential obtained by reducing $V_{cenf255}$ by $$\frac{1}{4}\cdot\frac{C_{sd}}{C_{lc}+C_s+C_{sd}}(V_{H0}+V_{L0}-V_{H255}-V_{L255})$$

(where $C_{sd}$ is a parasitic capacitance formed between the data signal line and a drain of the switching element, $C_{lc}$ is a liquid crystal capacitance, $C_s$ is a storage capacitance, $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{H255}$ is a potential set for the data signal line to apply a positive potential required for display of gray level 255 to the pixel electrode, and $V_{L255}$ is a potential set for the data signal line to apply a negative potential required for display of gray level 255 to the pixel electrode) as a potential $V_{cen255}$ of the common electrode in the case of display of gray level 255 for all the plurality of pixels.

4. A potential setting method for a liquid crystal display device including a plurality of data signal lines, a plurality of scanning signal lines intersecting with the plurality of data signal lines, and a plurality of pixels arranged in a matrix to correspond to intersections between the plurality of data signal lines and the plurality of scanning signal lines, each of the pixels including a switching element that is on when the corresponding scanning signal line is in a selected state and is off when it is in a non-selected state, a pixel electrode connected to the corresponding data signal line via the switching element, a common electrode opposed to the pixel electrode, and a liquid crystal layer sandwiched between the pixel electrode and the common electrode, the method at least comprising the steps of:

displaying gray level 0 as black display and gray level 255 as white display alternately every pixel;

determining a voltage $V_{cenf255}$ of the common electrode at which flicker is minimum during the alternate display of gray level 0 and gray level 255 every pixel;

displaying gray level 0 and gray level a as an arbitrary halftone alternately every pixel;

determining a voltage $V_{cenfa}$ of the common electrode at which flicker is minimum during the alternate display of gray level 0 and gray level a every pixel;

displaying gray level 0 and gray level b as an arbitrary halftone alternately every pixel;

determining a voltage $V_{cenfb}$ of the common electrode at which flicker is minimum during the alternate display of gray level 0 and gray level b every pixel;

displaying gray level a for all the plurality of pixels;

determining a voltage $V_{cena}$ of the common electrode at which flicker is minimum during the display of gray level a for all the plurality of pixels;

displaying gray level b for all the plurality of pixels;

determining a voltage $V_{cenb}$ of the common electrode at which flicker is minimum during the display of gray level b for all the plurality of pixels;

measuring a characteristic between a liquid crystal capacitance and a voltage applied to the liquid crystal layer;

determining voltages applied to the liquid crystal layer in gray level a, gray level b, and gray level 255;

determining liquid crystal capacitances $C_{lca}$, $C_{lcb}$, and $C_{lc225}$ in gray level a, gray level b, and gray level 255, respectively, based on the characteristic between the liquid crystal capacitance and the voltage applied to the liquid crystal layer and the voltages applied to the liquid crystal layer in gray level a, gray level b, and gray level 255; and setting a voltage obtained by adding $$\frac{v_{255}}{\left(\frac{v_a}{\Delta V_{cen_a}}-\frac{v_b}{\Delta V_{cen_b}}\right)\cdot C_{lc_{255}}\cdot\frac{1-\frac{C_{lc_a}}{C_{lc_{255}}}}{\frac{C_{lc_a}}{C_{lc_{255}}}-\frac{C_{lc_b}}{C_{lc_{255}}}}+\frac{v_a}{\Delta V_{cen_a}}}$$

(where $\Delta V_{cena}=V_{cena}-V_{cenfa}$, $\Delta V_{cenb}=V_{cenb}-V_{cenfb}$, $\upsilon_a=-(V_{H0}+V_{L0}-V_{Ha}-V_{La})$, $\upsilon b=-(V_{H0}+V_{L0}-V_{Hb}-V_{Lb})$, $\upsilon_{255}=-(V_{H0}+V_{L0}-V_{H255}-V_{L255})$, $V_{H0}$ is a potential set for the data signal line to apply a positive potential required for display of gray level 0 to the pixel electrode, $V_{L0}$ is a potential set for the data signal line to apply a negative potential required for display of gray level 0 to the pixel electrode, $V_{Ha}$ is a potential set for the data signal line to apply a positive potential required for display of gray level a to the pixel electrode, $V_{La}$ is a potential set for the data signal line to apply a negative potential required for display of gray level a to the pixel electrode, $V_{Hb}$ is a potential set for the data signal line to apply a positive potential required for display of gray level b to the pixel electrode, $V_{Lb}$ is a potential set for the data signal line to apply a negative potential required for display of gray level b to the pixel electrode, $V_{H255}$ is a potential set for the data signal line to apply a positive potential required for display of gray level 255 to the pixel electrode, and $V_{L255}$ is a potential set for the data signal line to apply a negative potential required for display of gray level 255 to the pixel electrode) to the voltage $V_{cenf255}$ of the common electrode as a voltage $V_{cen255}$ of the common electrode in the case of display of gray level 255 for all the plurality of pixels.

* * * * *